US012429055B2

(12) United States Patent
Kamei et al.

(10) Patent No.: US 12,429,055 B2
(45) Date of Patent: Sep. 30, 2025

(54) COMPRESSOR UNIT

(71) Applicant: DAIKIN INDUSTRIES, LTD., Osaka (JP)

(72) Inventors: Shota Kamei, Osaka (JP); Tatsuya Katayama, Osaka (JP); Daiki Kikutake, Osaka (JP); Keiji Komori, Osaka (JP); Shogo Tsuchikawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 30 days.

(21) Appl. No.: 18/621,027

(22) Filed: Mar. 28, 2024

(65) Prior Publication Data

US 2024/0240639 A1 Jul. 18, 2024

Related U.S. Application Data

(63) Continuation of application No. PCT/JP2022/022356, filed on Jun. 1, 2022.

(30) Foreign Application Priority Data

Sep. 30, 2021 (JP) ..... 2021-161006

(51) Int. Cl.
*F04C 29/00* (2006.01)

(52) U.S. Cl.
CPC ..... *F04C 29/0085* (2013.01); *F04C 2240/30* (2013.01); *F04C 2240/40* (2013.01)

(58) Field of Classification Search
CPC ..... F04C 29/0085; F04C 2240/30; F04C 2240/40; F04C 18/356; F04C 18/3564;
(Continued)

(56) References Cited

U.S. PATENT DOCUMENTS 8,221,096 B2 * 7/2012 Taniwa ..... H02K 1/185 310/216.136
2018/0291903 A1 * 10/2018 Higuchi ..... F04C 29/0021
2024/0263631 A1 * 8/2024 Katayama ..... F04C 18/356

FOREIGN PATENT DOCUMENTS

EP 2472116 A2 * 7/2012 ..... F04C 29/06
JP 2001-317479 A 11/2001
(Continued)

OTHER PUBLICATIONS

International Search Report of corresponding PCT Application No. PCT/JP2022/022356 dated Aug. 2, 2022.
(Continued)

*Primary Examiner* — Jesse S Bogue
(74) *Attorney, Agent, or Firm* — GLOBAL IP COUNSELORS, LLP

(57) ABSTRACT

A compressor unit includes a compressor and an accumulator. The compressor includes a vertically elongated first casing, an electric motor, a drive shaft, and a compression mechanism. The accumulator includes a vertically elongated second casing. In a frequency range between a value three times larger than a maximum compressor rotation speed and 1.25 times greater than the value when a first part is vibrated, an index showing a frequency response function of the second casing in a circumferential direction in a second part is 1.0 $m/s^2/N$ or less. The first part is part of an upper part of a side surface of the first casing and is orthogonal to an alignment direction of the compressor and the accumulator, and the second part is part of an upper part of a side surface of the second casing and is opposed to a part facing the first casing.

20 Claims, 9 Drawing Sheets

(58) Field of Classification Search
CPC ..... F04C 23/008; F04C 29/06; F04C 29/12; F04B 39/0055; F04B 39/0061
See application file for complete search history.

(56) References Cited

FOREIGN PATENT DOCUMENTS

| | | | | | |
|---|---|---|---|---|---|
| JP | 2012026273 | A | * | 2/2012 | |
| KR | 100498379 | B1 | * | 7/2005 | ..... F01C 21/007 |
| KR | 10-2014-0112317 | A | | 9/2014 | |
| WO | 2011/034164 | A1 | | 3/2011 | |
| WO | WO-2016006167 | A1 | * | 1/2016 | ..... F04C 23/008 |
| WO | WO-2017130916 | A1 | * | 8/2017 | ..... F04B 39/0072 |
| WO | 2017/216875 | A1 | | 12/2017 | |

OTHER PUBLICATIONS

European Search Report of corresponding EP Application No. 22 87 5457.8 dated Jan. 8, 2025.
International Preliminary Report of corresponding PCT Application No. PCT/JP2022/022356 dated Apr. 11, 2024.

* cited by examiner

COMPRESSOR UNIT

CROSS-REFERENCE TO RELATED APPLICATIONS

This is a continuation of International Application No. PCT/JP2022/022356 filed on Jun. 1, 2022, which claims priority to Japanese Patent Application Nos. 2021-161006, filed on Sep. 30, 2021. The entire disclosures of these applications are incorporated by reference herein.

BACKGROUND

Technical Field

The present disclosure relates to a compressor unit.

Background Art

Japanese Unexamined Patent Publication No. 2001-317479 discloses a compressor where an accumulator is fixed to a side surface of a casing of the compressor via a bracket. By adjusting the position of the bracket, vibration and noise of the accumulator are reduced.

SUMMARY

A first aspect of the present disclosure is directed to a compressor unit including a compressor and an accumulator adjacent to the compressor. The compressor includes a first casing that is vertically elongated, an electric motor housed in the first casing, a drive shaft driven by the electric motor, and a compression mechanism configured to compress a fluid. The accumulator includes a second casing that is vertically elongated. In a frequency range between a frequency having a value three times larger than a maximum rotation speed of the compressor and a frequency 1.25 times greater than the frequency having a value three times larger than the maximum rotation speed of the compressor when a first part is vibrated, an index showing a frequency response function of the second casing in a circumferential direction in a second part is 1.0 $m/s^2/N$ or less. The first part is a part of an upper part of a side surface of the first casing and is orthogonal to an alignment direction of the compressor and the accumulator, and the second part is a part of an upper part of a side surface of the second casing and is opposed to a part facing the first casing.

BRIEF DESCRIPTION OF THE DRAWINGS

FIG. 7A is a schematic diagram of the compressor and the accumulator as viewed from front. FIG. 7B is a schematic view of the compressor and the accumulator as viewed from above.

DETAILED DESCRIPTION OF EMBODIMENT(S)

An embodiment of the present disclosure will be described with reference to the drawings. The following embodiment is merely an exemplary one in nature, and is not intended to limit the scope, applications, or use of the present invention. Features of the embodiment, variations, and other examples described below can be combined or partially substituted within the range where the present invention can be embodied.

(1) COMPRESSOR UNIT

Figure 1:
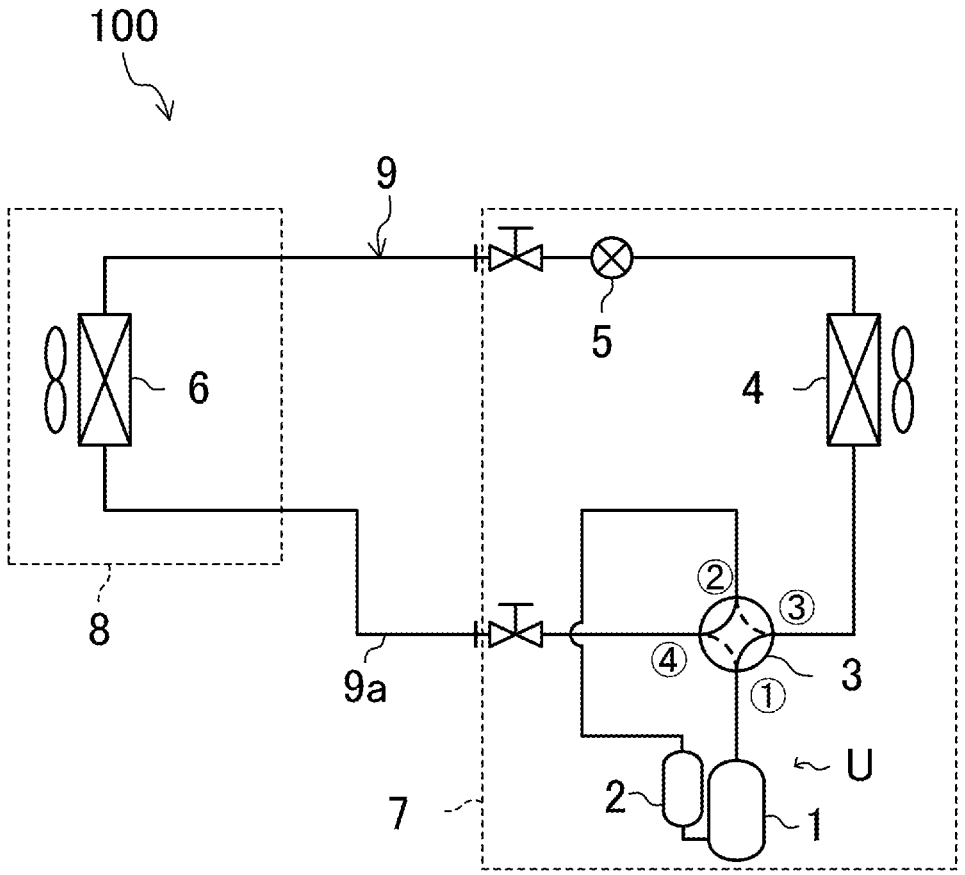
FIG. 1 is a piping system diagram of a refrigeration apparatus of an embodiment.
Figure 2:
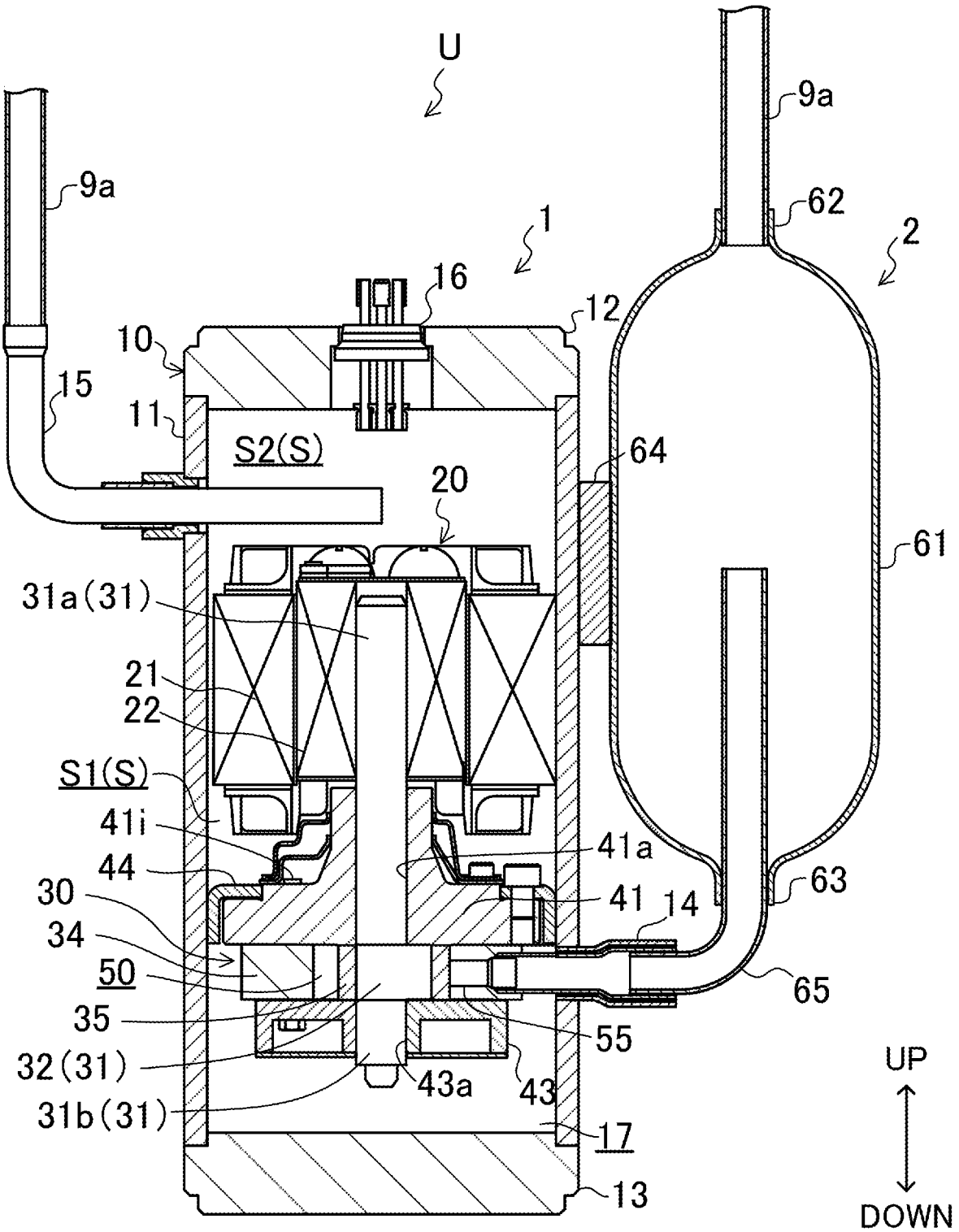
FIG. 2 is a vertical sectional view of a compressor unit.

As shown in FIGS. 1 and 2, a compressor unit (U) of this example is applied to a refrigeration apparatus (100). The refrigeration apparatus (100) is an air conditioner for conditioning air in a room, for example. The refrigeration apparatus (100) includes a refrigerant circuit (9). The refrigerant circuit (9) includes a compressor (1), an accumulator (2), a four-way switching valve (3), an outdoor heat exchanger (4), an expansion valve (5), and an indoor heat exchanger (6). These components are connected by a refrigerant pipe (9*a*). The refrigerant circuit (9) performs a refrigeration cycle where a refrigerant flows through the refrigerant pipe (9*a*) and circulates through the components. An outdoor unit (7) placed outdoors includes the compressor (1), the four-way switching valve (3), the outdoor heat exchanger (4), and the expansion valve (5). An indoor unit (8) placed indoors includes the indoor heat exchanger (6).

The compressor unit (U) of this embodiment includes the compressor (1) and the accumulator (2). The compressor (1) and the accumulator (2) are of a vertical type. The compressor (1) and the accumulator (2) are fixed to each other by a fixing member (64) which will be described later.

(2) COMPRESSOR

This compressor (1) is a rotary compressor. The compressor (1) compresses a refrigerant flowing through the refrigerant circuit. The compressor (1) includes a closed container (10), an electric motor (20), and a compression mechanism (30). The electric motor (20) and the compression mechanism (30) are housed in the closed container (10). The compressor (1) is of what is called a "high-pressure dome" type, where a refrigerant compressed in the compression mechanism (30) is discharged into an internal space (S) of the closed container (10) so that the pressure in the internal space (S) becomes high.

(2-1) Closed Container

The closed container (10) is vertically long. Specifically, the closed container (10) includes a cylindrical barrel (11)

extending vertically, an upper end plate (12) closing an upper end of the barrel (11), and a lower end plate (13) closing a lower end of the barrel (11). The closed container (10) is an example of the first casing (10) of the present disclosure. The upper end plate (12) and the lower end plate (13) are relatively thick. The barrel (11) has a lower part provided with a suction pipe (14).

The suction pipe (14) is relatively thick. Specifically, the difference between an inner diameter and an outer diameter of the suction pipe (14) is 1.0 mm to 2.8 mm, and is 2.8 mm in one preferred embodiment. The upper end plate (12) is provided with a discharge pipe (15) and a terminal (16) for supplying electric power to the electric motor (20).

The refrigerant pipe (9*a*) is inserted into the discharge pipe (15). The closed container (10) has a bottom provided with an oil reservoir (17). The barrel (11) has an inner circumferential surface in substantially the middle of which a mounting plate (44) is fixed.

(2-2) Electric Motor

The electric motor (20) is housed in the closed container (10). The electric motor (20) drives the compression mechanism (30). The electric motor (20) is located above the mounting plate (44). The internal space (S) is divided into a first internal space (S1) below the electric motor (20) and a second internal space (S2) above the electric motor (20). The electric motor (20) includes a tubular stator (21) along the inner circumferential surface of the barrel (11), and a rotor (22) inside the stator (21).

(2-3) Drive Shaft

The drive shaft (31) extends vertically in the closed container (10). The drive shaft (31) is driven by the electric motor (20). The drive shaft (31) has a top part connected to the rotor (22) of the electric motor (20). The drive shaft (31) has a lower part including an upper shaft part (31*a*), an eccentric part (32), and a lower shaft part (31*b*) in this order from top to bottom. The eccentric part (32) is eccentric with respect to the center of the axis of the drive shaft (31). The eccentric part (32) has a diameter larger than those of the upper shaft part (31*a*) and the lower shaft part (31*b*).

(2-4) Compression Mechanism

The compression mechanism (30) is housed in the closed container (10). The compression mechanism (30) compresses a sucked fluid and discharges the compressed fluid to the internal space (S) of the closed container (10). Specifically, the compression mechanism (30) is placed on the lower surface of the mounting plate (44) and is fixed by the mounting plate (44). The compression mechanism (30) includes a drive shaft (31), a cylinder (34), a front head (41), a rear head (43), and a piston (35).

(2-5) Cylinder and Piston

Figure 3:
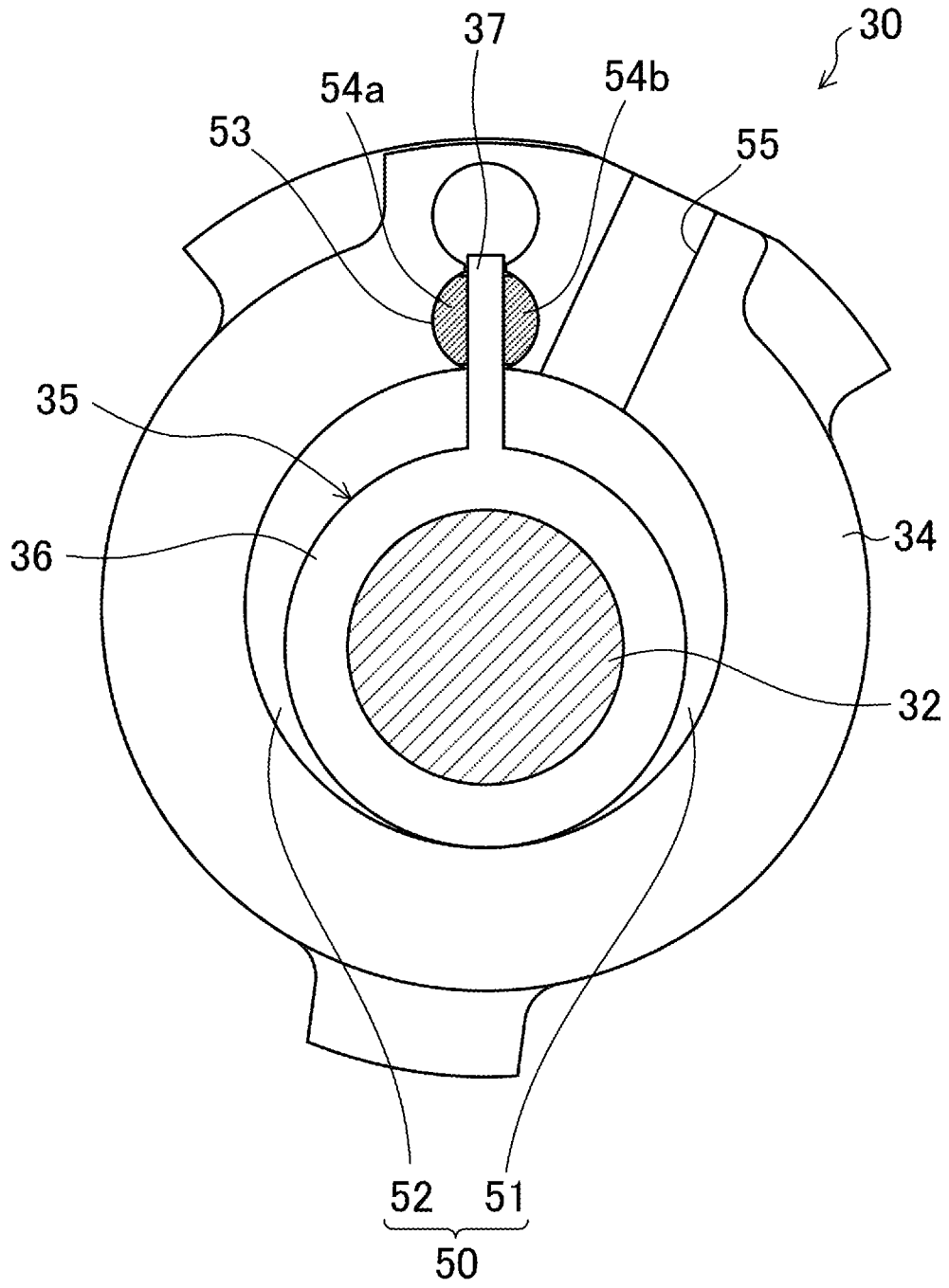
FIG. 3 is a plan view of a piston.

As shown in FIGS. 2 and 3, the cylinder (34) is in a substantially cylindrical shape. The axis of the cylinder (34) extends vertically. The eccentric part (32) of the drive shaft (31) is inserted into the cylinder (34).

The piston (35) is housed in the cylinder (34). The piston (35) slides on both the upper front head (41) and the lower rear head (43). The piston (35) includes a piston body (36) and a blade (37).

The piston body (36) is in a ring shape. Specifically, the piston body (36) is in a slightly thick cylindrical shape. The eccentric part (32) of the drive shaft (31) is inserted slidably. When the drive shaft (31) rotates, the piston body (36) revolves along the inner circumferential surface of the cylinder (34). A compression chamber (50) is formed between the piston body (36) and the cylinder (34).

The blade (37) is integral with the piston body (36). The blade (37) protrudes radially outward from an outer circumferential surface of the piston body (36). The blade (37) is sandwiched between a pair of swing bushes (54*a*, 54*b*) provided in a bush groove (53) extending radially outward from the inner circumferential surface of the cylinder (34). The blade (37) restricts the rotation of the piston body (36) when the piston body (36) revolves. The blade (37) divides the compression chamber (50) into a low-pressure chamber (51) and a high-pressure chamber (52).

A suction port (55) penetrates the cylinder (34) radially. The suction port (55) has an inner circumferential end communicating with the low-pressure chamber (51) and an outer circumferential end connected to the suction pipe (14).

(2-6) Front Head and Rear Head

The front head (41) is fixed to an upper end of the cylinder (34). The front head (41) closes the upper end of the cylinder (34). The front head (41) includes a bearing (41*a*) that rotatably supports the upper shaft part (31*a*) of the drive shaft (31). A discharge valve (41*i*) is provided in a discharge port (not shown) that communicates the high-pressure chamber (52) and the first internal space (S1). When the pressure of a refrigerant in the high-pressure chamber (52) reaches or exceeds a predetermined value, the discharge valve (41*i*) opens.

The rear head (43) is fixed to a lower end of the cylinder (34). The rear head (43) closes the lower end of the cylinder (34). The rear head (43) includes a bearing (43*a*) that rotatably supports the lower shaft part (31*b*) of the drive shaft (31).

(3) ACCUMULATOR

The accumulator (2) temporarily stores a refrigerant sucked by the compressor (1). The accumulator (2) separates gas and liquid from each other. Specifically, the accumulator (2) separates a liquid refrigerant, refrigerating machine oil, and the like contained in a gaseous refrigerant. The accumulator (2) includes a casing (61), an outlet pipe (65), and the fixing member (64).

(3-1) Casing

The casing (61) is vertically long. The casing (61) is a closed container in a cylindrical shape. The casing (61) is an example of the second casing (61) of the present disclosure. The casing (61) is oriented to be vertically long. The second casing (61) is made of metal (e.g., iron). The casing (61) has an upper end provided with an inlet (62). The refrigerant pipe (9*a*) is inserted into the inlet (62). The inlet (62) and the refrigerant pipe (9*a*) are fixed to each other by welding, for example. A refrigerant in the refrigerant circuit (9) flows into the casing (61) through the inlet (62). The casing (61) has a lower end provided with an outlet (63). The outlet pipe (65) is inserted into the outlet (63). The outlet (63) and the outlet pipe (65) are fixed to each other by welding, for example.

(3-2) Outlet Pipe

The outlet pipe (65) is made of metal (e.g., copper). The outlet pipe (65) has one end extending upward in the casing (61) from the outlet (63). This one end of the outlet pipe (65) is located above the middle of the casing (61). The outlet pipe (65) has another end inserted into the suction pipe (14). This other end of the outlet pipe (65) and the suction pipe (14) are fixed to each other by welding, for example.

(3-3) Fixing Member

Figure 4A:
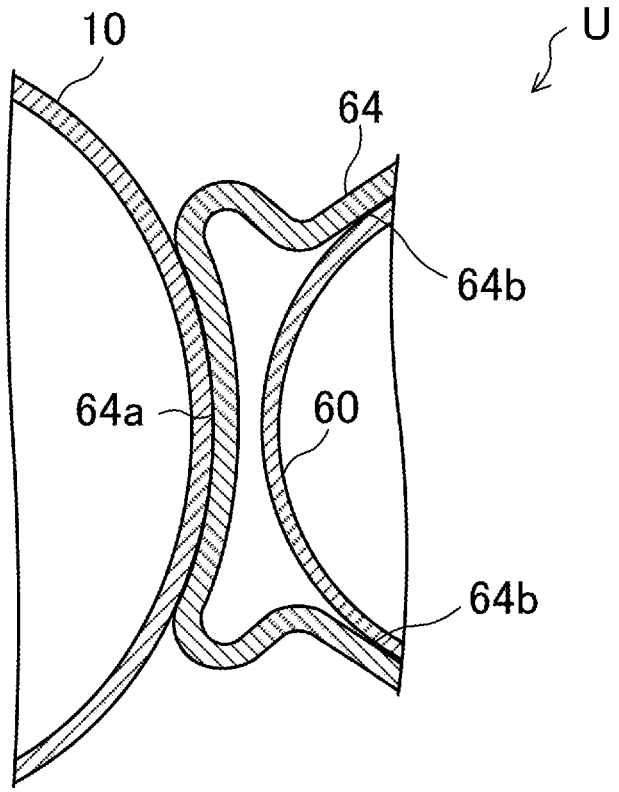
FIG. 4A is a partially enlarged transverse sectional view showing that a compressor and an accumulator are fixed by a fixing member.
Figure 4B:
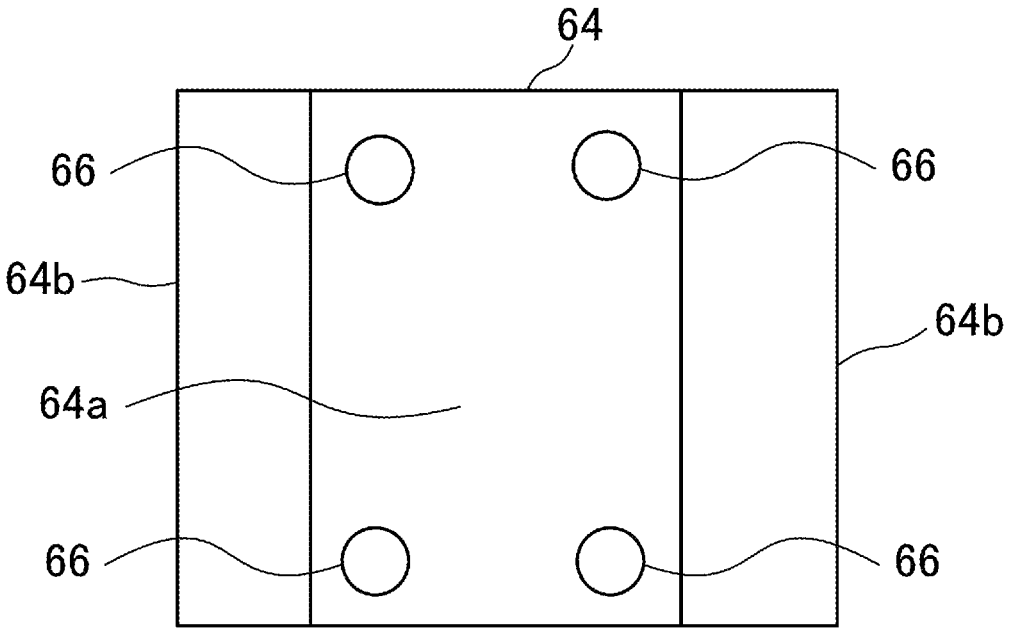
FIG. 4B shows the fixing member as viewed from the compressor.
Figures 5A, 5B, 5C, 5D, 5E, 5F, 5G, 5H:
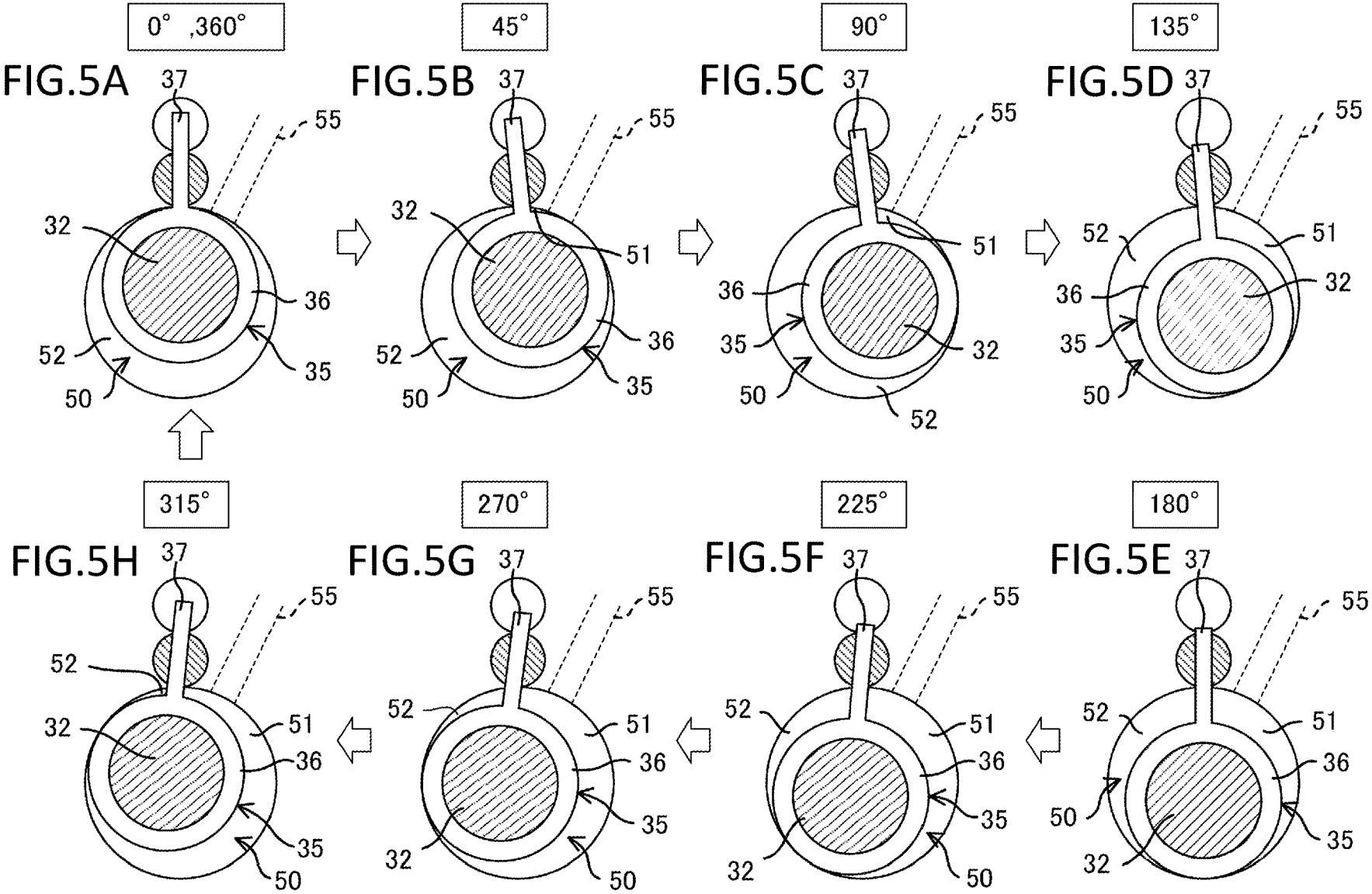
FIG. 5A, FIG. 5B, FIG. 5C, FIG. 5D, FIG. 5E, FIG. 5F, FIG. 5G, and FIG. 5H show operation of a compression mechanism.

As shown in FIG. 4A and FIG. 4B, the fixing member (64) fixes the closed container (10) and the casing (61). The fixing member (64) is a metal plate member. The fixing member (64) includes a first surface (64*a*) in contact with the side surface (i.e., the barrel (11)) of the closed container (10), and two second surfaces (64*b*) in contact with the side surface of the casing (61) (FIG. 4A). The first surface (64*a*) curves along the side surface of the closed container (10). The first surface (64*a*) is in a rectangular shape. The two second surfaces (64*b*) are located at circumferential ends of the first surface (64*a*). The second surfaces (64*b*) are welded to the side surface of the casing (61) so that the fixing member (64) is fixed to the casing (61).

The first surface (64*a*) includes projections (66) for welding (see FIG. 4B). The projections (66) are located at four corners of the first surface (64*a*) before being welded. When the projections (66) are welded, the first surface (64*a*) is fixed to the closed container (10). The first surface (64*a*) has a vertical length (i.e., a length along the cylinder shaft of the closed container) of 32 mm to 38 mm, and 38 mm in one preferred embodiment.

(4) OPERATION

As shown in FIG. 5A, FIG. 5B, FIG. 5C, FIG. 5D, FIG. 5E, FIG. 5F, FIG. 5G, and FIG. 5H, in the compressor (1), when the electric motor (20) starts to rotate the rotor (22), the drive shaft (31) rotates and the eccentric part (32) rotates eccentrically. As the eccentric part (32) rotates eccentrically, the piston (35) restricting its rotation revolves along the inner circumferential surface of the cylinder (34).

A suction phase of sucking a refrigerant into the compression chamber (50) will be described. When the drive shaft (31) slightly turns from an angle of 0° (the state in FIG. 5A), the contact point between the piston (35) and the cylinder (34) passes through the inner circumferential end of the suction port (55). At this time, the suction of a refrigerant into the low-pressure chamber (51) starts.

A refrigerant is sucked from the suction pipe (14) through the suction port (55). As the rotation angle of the drive shaft (31) increases, the volume of the low-pressure chamber (51) gradually increases, and then the amount of a refrigerant sucked into the low-pressure chamber (51) increases (the states in FIGS. 5B to 5H). This suction phase of sucking a refrigerant continues until the rotational angle of the drive shaft (31) reaches 360°, and then shifts to a discharge phase.

Next, the discharge phase of compressing and discharging a refrigerant in and from the compression chamber (50) will be described. When the drive shaft (31) slightly turns from an angle of 0° (the state in FIG. 5A), the contact point between the piston (35) and the cylinder (34) passes again through the inner circumferential end of the suction port (55). At this time, the confinement of a refrigerant in the low-pressure chamber (51) is complete.

The low-pressure chamber (51) connected to the suction port (55) serves as a high-pressure chamber (52) connected only to a discharge port (not shown). From this state, the compression of a refrigerant in the high-pressure chamber (52) starts. As the rotation angle of the drive shaft (31) increases, the volume of the high-pressure chamber (52) decreases, and then the pressure of the high-pressure chamber (52) increases. When the pressure of the high-pressure chamber (52) exceeds a predetermined value, the discharge valve (41*i*) opens. At this time, a refrigerant in the high-pressure chamber (52) is discharged through the discharge port (not shown) and flows into the first internal space (S1). This gas refrigerant moves to the second internal space (S2) and then is discharged to the outside of the compressor (1) through the discharge pipe (15). The discharge phase of discharging a refrigerant continues until the rotational angle of the drive shaft (31) reaches 360°, and then shifts to the suction phase. In this manner, the compressor (1) continuously performs the compression operation of a refrigerant by alternating the suction phase and the discharge phase in the compression chamber (50).

(5) PROBLEMS IN VIBRATION ON SURFACE OF ACCUMULATOR IN HIGH-SPEED ROTATION OF COMPRESSOR

It is typically known that there are larger vibrations on the surface of an accumulator when a structural eigenvalue of the accumulator and a 1N-frequency component of an electric motor interfere with each other at an operation frequency of 10 Hz to 120 Hz. The structural eigenvalue is a frequency specific to the accumulator and independent from the operation frequency of the compressor. The structural eigenvalue of the accumulator (2) of this example is around 500 Hz.

When the compressor operates at a relatively low rotation speed, interference is prevented between a structural eigenvalue of the accumulator and a 3N-frequency component of the electric motors. However, the following problem has been found: when the compressor rotates at a high speed (e.g., 120 rps or more), and a structural eigenvalue of the accumulator and a 3N-component of the electric motor interfere with each other, there are larger vibrations on the surface of the accumulator, particularly, larger circumferential vibrations on an upper portion of the casing surface of the accumulator.

To address the problem, the compressor unit (U) of this example is configured so that, at a frequency having a value three times larger than the maximum rotation speed of the compressor (1) when a first part is vibrated, an index showing a frequency response function of the casing (61) in the circumferential direction in a second part is 1.0 $m/s^2/N$ or less, where the first part is a part of an upper part of the side surface (the barrel (11)) of the closed container (10) and is orthogonal to the alignment direction of the compressor (1) and the accumulator (2), and the second part is a part of an upper part of the side surface of the casing (61) and is opposed to a part facing the closed container (10).

Specifically, in the compressor unit (U) of this example, as described above, the fixing member (64) is directly welded to the accumulator (2), and the fixing member (64) and the compressor (1) are welded at four points (i.e., the projections (66)). In addition, the suction pipe (14) is relatively thick, and the suction pipe (14) and the outlet pipe (65) are fixed by brazing. The fixing member (64) has a vertical width of 38 mm. With such measures taken, the accumulator (2) has a more rigid attachment structure than a typical compressor unit. With a more rigid attachment structure, the structural eigenvalue of the accumulator (2) shift to a higher frequency, and thus interference can be prevented between the structural eigenvalue and the 3N-component of the electric motor. As a result, even when the compressor (1) rotates at a high speed, there are smaller vibrations on the surface of the accumulator (2). The details will be described below.

(6) RELATIONSHIP BETWEEN ROTATION SPEED OF COMPRESSOR AND VIBRATION ACCELERATION OF ACCUMULATOR

The compressor of this example operated at the maximum rotation speed of 138 rps has a relatively high influence on the circumferential vibration acceleration at an upper part of the casing (61) of the accumulator (2) of this example. For example, there was less influence on the radial vibration acceleration at the upper part of the surface of the casing (61) than the circumferential vibration acceleration.

Figure 6:
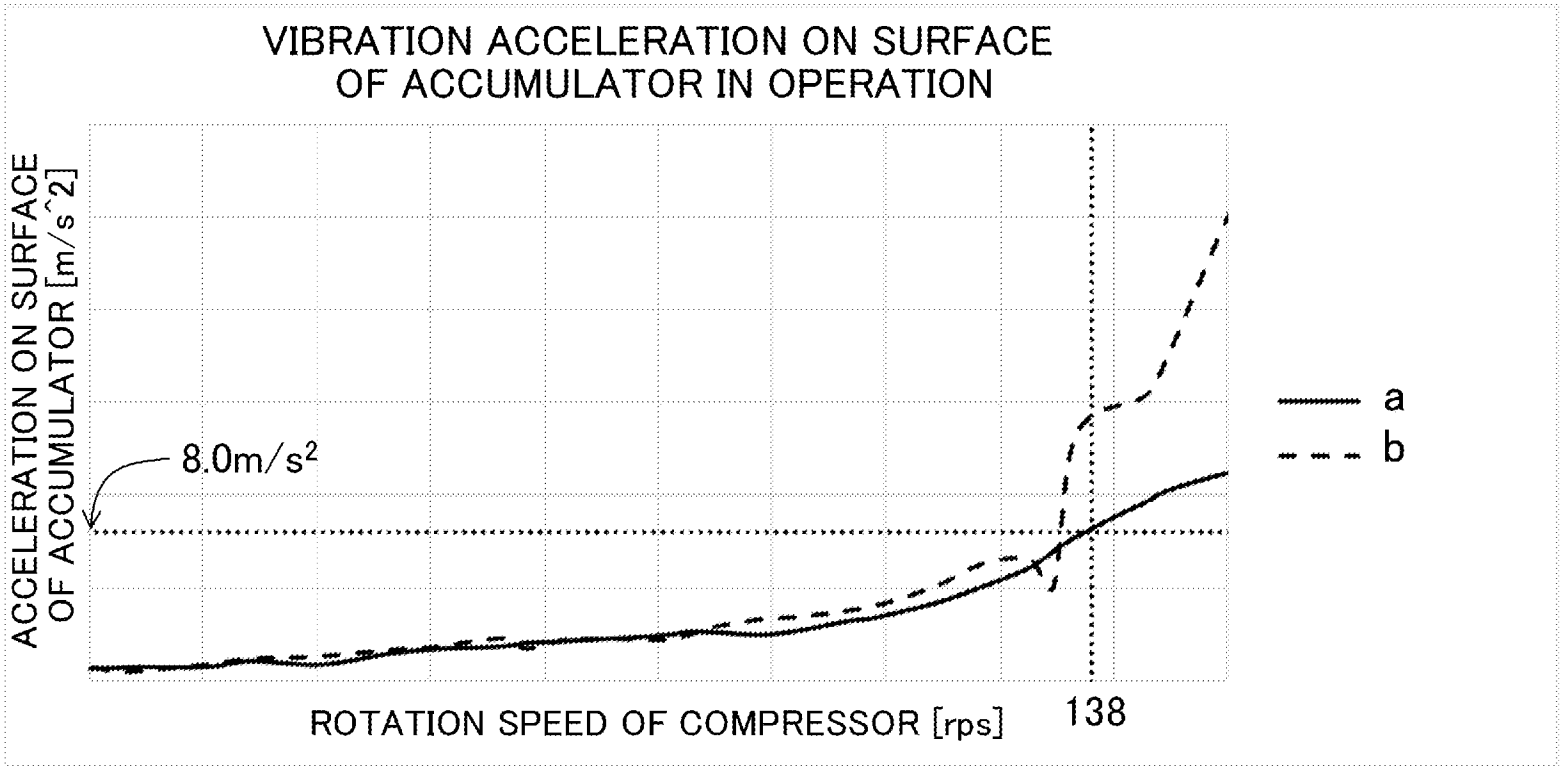
FIG. 6 shows data about a comparison between vibration characteristics of an accumulator of the compressor unit of this embodiment and vibration characteristics of an accumulator of a typical compressor unit when a compressor is operated.

In FIG. 6, the solid line (a) shows the circumferential vibration acceleration at the upper part of the surface of the casing (61) of the accumulator (2) of this example. In FIG. 6, the broken line (b) shows the circumferential vibration acceleration at an upper part of a casing surface of a typical accumulator. As shown in FIG. 6, the compressor unit (U) of this example and the typical compressor unit are different in vibration characteristics where the compressor is in operation. Note that both of the compressor units are connected with the refrigerant pipe (9*a*). In the following description, the circumferential vibration acceleration at an upper part of the casing surface of the accumulator may be simply referred to as a vibration acceleration.

Here, a vibration acceleration when the compressor operates at the maximum rotation speed and interference is prevented between the structural eigenvalue of the accumulator and the 3N-frequency component of the electric motor is defined as a target vibration acceleration. In this example, the target vibration acceleration where the rotation speed of the compressor is the maximum rotation speed of 138 rps is 8 $m/s^2$ or less. Specifically, in this example, when the compressor operates at the maximum rotation speed and the vibration acceleration is 8 $m/s^2$ or less, interference is prevented between the structural eigenvalue of the accumulator (2) and the 3N-frequency component of the electric motor, thereby reducing the vibration on the surface of the casing (61) of the accumulator (2). On the other hand, when the vibration acceleration is more than 8 $m/s^2$, there is interference between the structural eigenvalue of the accumulator and the 3N-frequency component of the electric motor, thereby increasing the vibration on the surface of the casing (61) of the accumulator (2).

As shown in FIG. 6, when the compressor (1) operates at a rotation speed of 138 rps, the compressor unit (U) of this example exhibits a vibration acceleration of 8 $m/s^2$ or less. This satisfies the requirement of the target vibration acceleration. On the other hand, the typical compressor unit exhibits a vibration acceleration of more than 8 $m/s^2$ when the compressor operates at a rotation speed of 138 rps. This fails to satisfy the requirement of the target vibration acceleration. In this manner, when the compressor (1) operates at the maximum rotation speed (138 rps), the compressor unit (U) of this example can prevent interference between the frequency of the accumulator (around 500 hz) and the 3N-frequency component of the electric motor (20), thereby reducing the vibration of the accumulator (2).

(7) STUDY OF HAMMERING CONDITIONS

A hammering test was conducted to reproduce the characteristics of the compressor unit (U) of this example. It can be confirmed through the hammering test whether the compressor unit (U) can reduce the vibration on the surface of the accumulator (2) without actual operation of the compressor (1).

First, the conditions of the hammering test were studied. Specifically, a most suitable combination of the vibration position of the compressor (1) and the response position of the accumulator (2) when the compressor (1) operates at the maximum rotation speed, where the combination exhibits a tendency equivalent to the vibration characteristic of the accumulator (2), was studied.

The compressor (1) on an elastic member such as rubber was vibrated by a hammer (Model No. 086C01 manufactured by PCB Co., Ltd.), and the response was analyzed based on a value detected by an acceleration sensor (Model No. 3263A1 manufactured by DYTRAN Co., Ltd.) attached to an upper part of the surface of the accumulator (2). The analysis was conducted by using a piece of analysis software (manufactured by National Instruments Corporation) with the frequency response function (FRF) of the side surface of the casing (61) in the circumferential direction. Although the details will be described later, the reason for obtaining the FRF is that the compressor correlates with the vibration acceleration of the accumulator (2) that is in operation.

Figure 7A:
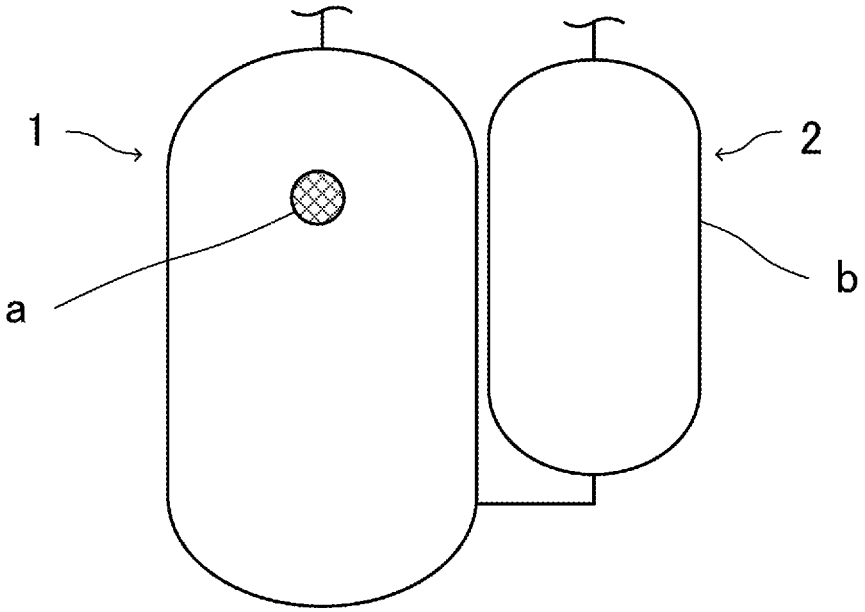
FIG. 7A and FIG. 7B show a vibration position and a response position of the compressor unit in a hammering test.
Figure 7B:
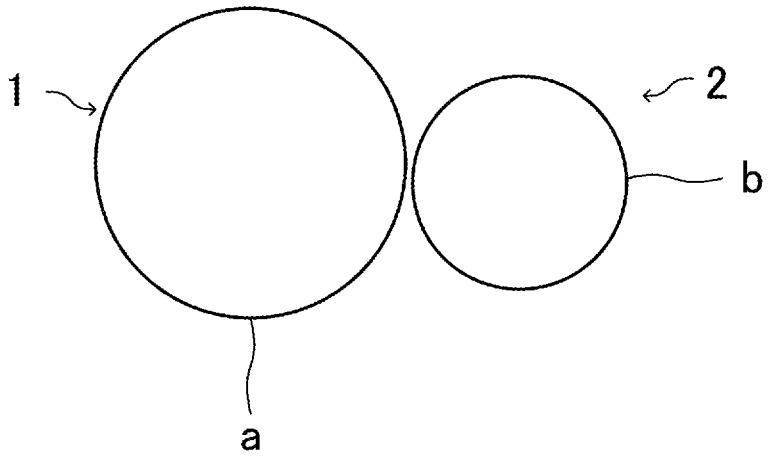

Referring to FIG. 7A and FIG. 7B, the vibration position shown in FIG. 7A, which is a part of an upper part of the side surface of the closed container (10) and which is orthogonal to the alignment direction of the compressor (1) and the accumulator (2). This part is the first part of the present disclosure. On the other hand, the response position is shown in FIG. 7B, which is a part of an upper part of the side surface of the casing (61) and which is opposed to a part facing the closed container (10). The FRF of the second part in the circumferential direction of the casing (61) when the first part is vibrated exhibited the same behavior as when the compressor (1) is in operation. Accordingly, under the hammering conditions of this example, the first part was regarded as a vibration position, and the second part as a response position. Note that the index showing the frequency response function (FRF) of this example is the accelerance (acceleration/force ($m/s^2/N$)).

Figure 8:
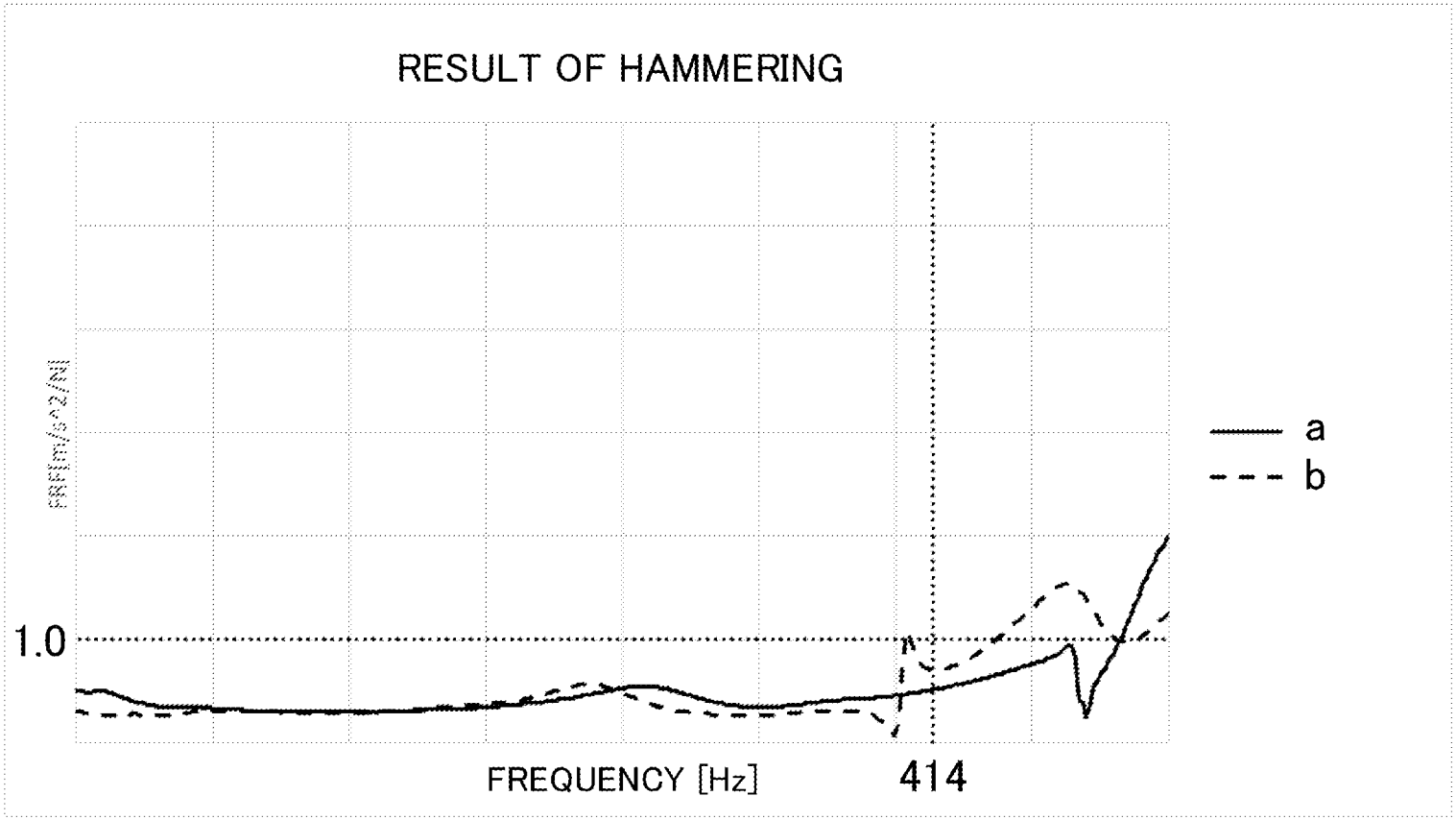
FIG. 8 shows data indicating the relationship between the frequency and the frequency response function of the accumulator in the hammering test.

Under the above hammering conditions, the compressor unit (U) of this example and a typical compressor unit were subjected to a hammering test. FIG. 8 shows the vibration characteristics of the accumulators of the compressor unit (U) of this example (the solid line (a)) and the typical compressor unit (the broken line (b)), where the horizontal axis shows the frequency (Hz) and the vertical axis shows the FRF ($m/s^2/N$).

Here, a frequency having around a value three times larger than the maximum rotation speed of the compressor, which is a 3N-frequency component of the electric motor, is defined as a first frequency. At the first frequency, an FRF which prevents interference between the frequency (around 500 Hz) of the accumulator and the 3N-frequency component of the electric motor (20) is defined as a target FRF. In this example, the first frequency was set to 414 Hz, where the maximum rotation speed of the compressor was 138 rps. The target FRF was set to 1.0 $m/s^2/N$ or less.

As shown in FIG. 8, the FRF of the compressor unit (U) of this example at 414 Hz was 0.92 $m/s^2/N$. The FRF of the typical compressor unit at a frequency around 414 Hz was 1.02 $m/s^2/N$. Accordingly, the compressor unit (U) of this example satisfies the target FRF, while the typical compressor unit (U) fails to satisfy the target FRF. This shows that the circumferential vibration acceleration at the upper part of the surface of the accumulator satisfies the target vibration acceleration of 8.0 $m/s^2$ or less when the compressor (1)

operates at a rotation speed of 138 rps. It is shown on the other hand that the typical compressor unit fails to satisfy the target vibration acceleration.

In this manner, the test was conducted under the hammering conditions described above without operation of the compressor. As a result, when a FRF value at the first frequency (414 Hz) satisfies the condition of 1.0 $m/s^2/N$ or less, interference can be prevented between the frequency (at and around 500 Hz) of the accumulator and the 3N-frequency component of the electric motor (20). thereby reducing an increase in the vibration on the surface of the casing (61) of the accumulator (2).

At the first frequency when the compressor (1) operates at a rotation speed of 120 rps or more, the FRF ($m/s^2/N$) correlates with the circumferential vibration acceleration ($m/s^2$) at an upper part of the side surface of the casing (61) of the accumulator (2). Although no data is given, the compressor unit (U) of this example and the typical compressor unit (U) each exhibited a correlation coefficient of 0.70 or more.

(8) FEATURES

8-1

The compressor unit (U) of this example is configured so that, at a first frequency having a value three times larger than the maximum rotation speed of the compressor (1) when a first part is vibrated, an index showing a frequency response function of the casing (61) in the circumferential direction in a second part is 1.0 $m/s^2/N$ or less, where the first part is a part of an upper part of the side surface of the closed container (10) (the first casing) of the compressor (1) and is orthogonal to the alignment direction of the compressor (1) and the accumulator (2), and the second part is a part of an upper part of the side surface of the casing (61) (the second casing) of the accumulator (2) and is opposed to a part facing the closed container (10).

Under the hammering conditions described above, when the index is 1.0 $m/s^2/N$ or less, collision can be prevented between the 3N-frequency component and the circumferential frequency at an upper part of the accumulator (2) when the compressor (1) operates at the maximum rotation speed. This can reduce the vibration on the surface of the casing (61) of the accumulator (2).

In addition, without operation of the compressor (1), it can be checked through the hammering test whether the compressor unit (U) can reduce the vibration on the surface of the casing (61) of the accumulator (2).

In addition, it can be confirmed through the hammering test whether the vibration on the surface of the accumulator (2) of the compressor unit (U) that is in operation can be reduced. Thus, it is unnecessary to operate the compressor (1) for the confirmation. This can reduce the manufacturing time of the compressor unit (U).

8-2

In the compressor unit (U) of this example, the index of the frequency response function of the casing (61) in the circumferential direction in the second part when the first part is vibrated is 1.0 $m/s^{22}/N$ or less, where the refrigerant pipe (9*a*) connected to the discharge pipe (15) of the compressor (1) and the suction pipe (14) of the accumulator (2).

It can be confirmed whether an increase in the vibration on the surface of the casing (61) of the accumulator (2) can be reduced even when the refrigerant pipe is attached to the compressor unit (U).

8-3

The compressor unit (U) of this example further includes a fixing member (64) having a plate shape; provided between the closed container (10) and the casing (61); and fixing the closed container (10) and the casing (61). The fixing member (64) has a first surface (64*a*) having a rectangular shape curving along the side surface of the closed container (10), and includes the first surface (64*a*) having four corners fixed to the closed container (10) by welding.

The four corners (four points) of the first surface (64*a*) of the fixing member (64) is welded to the closed container (10), and thus the index showing the frequency response function of the casing (61) in the circumferential direction in the second part when the first part is vibrated can be 1.0 $m/s^2/N$ or less. This can reliably reduce an increase in the vibration on the surface of the casing (61) of the accumulator (2).

8-4

In the compressor unit (U) of this example, the maximum rotation speed of the compressor (1) is 120 rps or more. When the compressor (1) operates at a rotation speed of 120 rps or more, an increase in the vibration on the surface of the casing (61) of the accumulator (2) can be reduced.

(9) VARIATIONS

In this example, hammering conditions with no refrigerant pipe connected to the compressor unit (U) of the present disclosure will be described.

Figure 9:
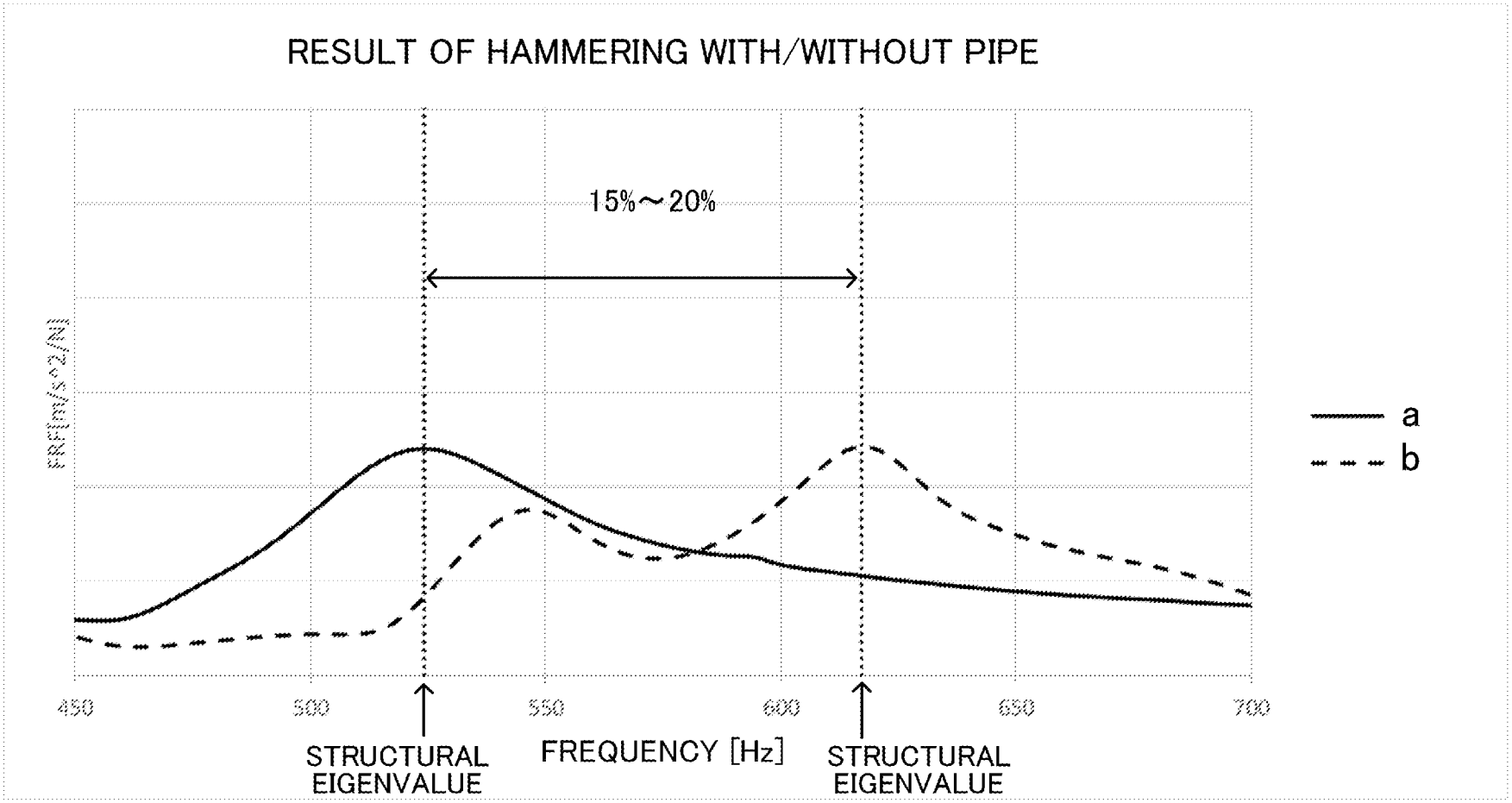
FIG. 9 is a graph showing a comparison in the relationship between the frequency and the frequency response function of the accumulator in the hammering test where a refrigerant pipe is attached and where a refrigerant pipe is detached.

The hammering test was conducted under the same conditions as those of the embodiment described above, with the refrigerant pipe (9*a*) detached from the compressor unit (U). The solid line (a) in FIG. 9 shows a test result where the refrigerant pipe (9*a*) is attached. The dashed line (b) in FIG. 9 shows a test result where the refrigerant pipe (9*a*) is detached.

As shown in FIG. 9, in the compressor unit (U) of this example where the refrigerant pipe (9*a*) is not connected, the structural eigenvalue of the accumulator (2) is higher by about 15% to 20% than where the refrigerant pipe (9*a*) is connected. Accordingly, the first frequency of the compressor unit (U) where the refrigerant pipe (9*a*) is not connected is higher by about 15% to 20%, i.e., about 1.15 times to 1.20 times than that of the compressor unit (U) where the refrigerant pipe (9*a*) is connected.

Specifically, if the maximum rotation speed of the compressor (1) is about 138 rps, the first frequency is 476 Hz to 496 Hz, which is a value obtained by multiplying a value three times larger than about 138 rps by 1.15 to 1.20. That is, in the compressor unit (U) of this example where the refrigerant pipe (9*a*) is not connected, the FRF from about 476 Hz to about 496 Hz satisfies 1.0 $m/s^2/N$ or less.

In this manner, when, under the hammering conditions of the embodiment, the FRF around 517 Hz satisfies the target FRF of 1.0 $m/S^2/N$ or less, interference can be prevented between the structural eigenvalue of the accumulator (2) and the 3N-frequency component n of the electric motor (20), and this can reduce an increase in the vibration on the surface of the accumulator (2).

(10) OTHER EMBODIMENTS

The above embodiment may also be configured as follows.

The maximum rotation speed of the compressor (1) only has to be 120 rps or more. When the rotation speed is 120 rps or more and the FRF at the first frequency satisfies 1.0 $m/s^2/N$ or less, the circumferential vibration acceleration is 8 $m/s^2$ or less at an upper part of the side surface of the casing (61) of the accumulator (2). This can reduce an increase in the vibration on the surface of the accumulator (2).

Whether the compressor unit (U) is connected to the refrigerant pipe (9*a*) or not, the first frequency only has to be within a frequency range between a frequency having a value three times larger than the maximum rotation speed of the compressor (1) and a frequency 1.25 times greater than the frequency having a value three times larger than the maximum rotation speed of the compressor (1). In this frequency range, when the FRF satisfies 1.0 $m/s^2/N$ or less, interference can be prevented between the structural eigenvalue of the accumulator (2) and the 3N-component of the compressor (1), and this can reduce an increase in the vibration on the surface of the accumulator (2).

The compressor unit (U) may include an elastic member fixed between the compressor (1) and the accumulator (2). This can attenuate propagation of the vibration from the compressor (1) to the accumulator (2). This can lower the level of response of the accumulator (2) to the vibration from the compressor (1), and this can reduce an increase in the vibration on the surface of the accumulator (2).

In the compressor unit (U), the outlet pipe (65) of the accumulator (2) may have a larger thickness, or a resin putty may be applied on the upper surface of the accumulator (2). This can reduce the vibration on the surface of the accumulator even when the compressor (1) rotates at the maximum rotation speed.

The compressor (1) of the compressor unit (U) may be a swing rotary compressor as in the above embodiment, or may be a rotary compressor with a vane.

While the embodiment and variations thereof have been described above, it will be understood that various changes in form and details may be made without departing from the spirit and scope of the claims. The foregoing embodiment and variation thereof may be combined and replaced with each other without deteriorating the intended functions of the present disclosure. The expressions of "first," "second," . . . described above are used to distinguish the terms to which these expressions are given, and do not limit the number and order of the terms.

As described above, the present disclosure is useful for a compressor unit.

The invention claimed is:

1. A compressor unit comprising:

a compressor, the compressor including a first casing that is vertically elongated, an electric motor housed in the first casing, a drive shaft driven by the electric motor, and a compression mechanism configured to compress a fluid; and an accumulator adjacent to the compressor, the accumulator including a second casing that is vertically elongated, and in a frequency range between a frequency having a value three times larger than a maximum rotation speed of the compressor and a frequency 1.25 times greater than the frequency having a value three times larger than the maximum rotation speed of the compressor when a first part is vibrated, an index showing a frequency response function of the second casing in a circumferential direction in a second part is 1.0 $m/s^2/N$ or less, where the first part is a part of an upper part of a side surface of the first casing and is orthogonal to an alignment direction of the compressor and the accumulator, and the second part is a part of an upper part of a side surface of the second casing and is opposed to a part facing the first casing.

2. The compressor unit of claim 1, wherein the index showing the frequency response function of the second casing in the circumferential direction in the second part when the first part is vibrated is 1.0 $m/s^2/N$ or less, where a discharge pipe of the compressor and a suction pipe of the accumulator are connected with a refrigerant pipe connected to a refrigerant circuit.

3. The compressor unit of claim 1, further comprising:

a fixing member having a plate shape, the fixing member being provided between the first casing and the second casing, and the fixing member being configured to fix the first casing and the second casing, the fixing member including a first surface having a rectangular shape curving along the side surface of the first casing, and including the first surface having four corners fixed to the first casing by welding.

4. The compressor unit of claim 2, further comprising:

a fixing member having a plate shape, the fixing member being provided between the first casing and the second casing, and the fixing member being configured to fix the first casing and the second casing, the fixing member including a first surface having a rectangular shape curving along the side surface of the first casing, and including the first surface having four corners fixed to the first casing by welding.

5. The compressor unit of claim 1, wherein a maximum rotation speed of the drive shaft of the compressor is 120 rps or more.

6. The compressor unit of claim 2, wherein a maximum rotation speed of the drive shaft of the compressor is 120 rps or more.

7. The compressor unit of claim 3, wherein a maximum rotation speed of the drive shaft of the compressor is 120 rps or more.

8. The compressor unit of claim 4, wherein a maximum rotation speed of the drive shaft of the compressor is 120 rps or more.

9. The compressor unit of claim 1, wherein the compressor is a rotary compressor.

10. The compressor unit of claim 2, wherein the compressor is a rotary compressor.

11. The compressor unit of claim 3, wherein the compressor is a rotary compressor.

12. The compressor unit of claim 4, wherein the compressor is a rotary compressor.

13. The compressor unit of claim 5, wherein the compressor is a rotary compressor.

14. The compressor unit of claim 6, wherein the compressor is a rotary compressor.

15. The compressor unit of claim 7, wherein the compressor is a rotary compressor.

16. The compressor unit of claim 8, wherein the compressor is a rotary compressor.

17. A refrigeration apparatus including the compressor unit of claim 1.

18. A refrigeration apparatus including the compressor unit of claim 2.

19. A refrigeration apparatus including the compressor unit of claim 3.

20. A refrigeration apparatus including the compressor unit of claim 4.

* * * * *